US005412890A

United States Patent [19]

Fechter

[11] Patent Number: 5,412,890

[45] Date of Patent: May 9, 1995

[54] NESTED TURNTABLE ARRANGEMENT FOR ELECTRONICALLY ANIMATED CHARACTERS

[76] Inventor: Aaron Fechter, 47 W. Jefferson St., Orlando, Fla. 32801

[21] Appl. No.: 33,298

[22] Filed: Mar. 17, 1993

[51] Int. Cl.[6] ..... G09F 19/08

[52] U.S. Cl. ..... 40/414; 40/419; 446/236; 446/332

[58] Field of Search ..... 40/411, 414, 415, 419, 40/430, 456; 446/332, 236; 472/75

[56] References Cited

U.S. PATENT DOCUMENTS

| | | | |
|---|---|---|---|
| 569,950 | 10/1896 | Boettcher | 40/415 |
| 631,306 | 8/1899 | Hollingsworth | 40/415 |
| 753,043 | 2/1904 | Cleal | 40/415 |
| 1,323,902 | 12/1919 | Obolewicz | 446/236 |
| 1,338,944 | 5/1920 | Majewski | 40/415 X |
| 1,389,372 | 8/1921 | Mitera | 446/236 |

*Primary Examiner*—Kenneth J. Dorner
*Assistant Examiner*—Joanne Silbermann
*Attorney, Agent, or Firm*—Warren L. Franz

[57] ABSTRACT

An animation show presentation has a base turntable (15) rotatable about a base axis (30), and pedestal turntables (35, 36, 37) supported on the base turntable for independent rotation about separate pedestal axes (38, 39, 40). Animated characters (32, 33, 34) respectively mounted on the pedestal turntables have arm body part segments (59, 60, 61) whose hand ends can be extended and brought into juxtaposed positions proximate the base axis (30), under rotation of the pedestal turntables. Rotating the base turntable with the hand ends thus juxtaposed causes the characters to appear to be dancing about an optional pole (63) placed coincident with base axis (30).

14 Claims, 2 Drawing Sheets

NESTED TURNTABLE ARRANGEMENT FOR ELECTRONICALLY ANIMATED CHARACTERS

This invention relates, in general, to animation shows of the type utilizing electronically animated robotic characters; and, in particular, to a cooperative arrangement of nested turntables for providing improved interaction among a plurality of such characters, especially to give the illusion of dancing.

BACKGROUND OF THE INVENTION

The term "animated character" as used herein is defined as an electronically controlled figure which is animated to simulate life-like motion by articulating a preprogrammed repertoire of movements. Such figures typically include a skeletal framework of relatively movable jointed segments concealed within an outer covering depicting arm, leg, head, torso, and other external features of a represented human or animal personality. Animation shows of the type to which the present invention relates are known from such multimedia animated character performances as are commonly seen in amusement-oriented pizza restaurant chains. Such shows employ computer-controlled, sound synchronized robotics to cause interaction among animated characters on adjacent stages, utilizing coordinated body movements, audiotapes, backdrop scenery and lighting.

It is known in such animation shows to provide life-sized animated characters with articulated movements corresponding to various ranges of life-like motion. Other examples of animated characters are those commonly seen in Disney TM theme park animatronics presentations. It is further known to support animated characters on movable turntables, such as revolving stages used to provide changes of scene. The audience-perceived interaction of characters achievable through such conventional arrangements is, however, limited.

SUMMARY OF THE INVENTION

It is an object of the present invention to provide a nested turntable arrangement for movably supporting a plurality of animated characters to provide improved perceived interaction among the characters and, especially, to provide the illusion of interactive dancing.

It is another object of the invention to provide a method for producing the illusion of dancing, using such an arrangement.

In accordance with the invention, a novel arrangement of supporting stages for animated characters includes a plurality of animated characters, each supported by an independently controllable rotating pedestal turntable, with the several pedestal turntables in turn all supported on a common, separately controllable rotating base turntable. The characters each have life-like features simulating body parts, including arms, legs, heads and torsos; and the pedestals are arranged relative to each other and to the revolving base, so that the characters can be rotated and their arms extended to bring the hands into juxtaposition proximate the axis of rotation of the base.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF THE PREFERRED EMBODIMENTS

The principles of the invention are illustrated, by way of example, embodied in an animation show employing a plurality of animated characters using synchronized sound robotic technology in a multimedia performance presentation.

Figure 1:
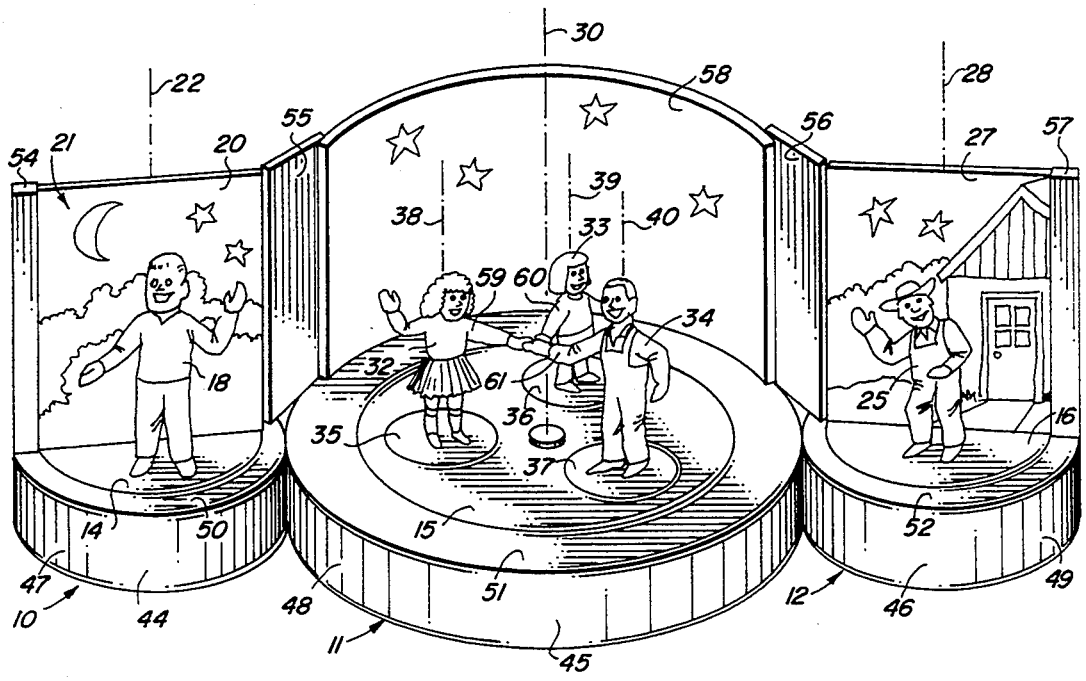
FIG. 1 is a front view of an animated show including a nested turntable arrangement in accordance with the principles of the invention.
Figure 2:
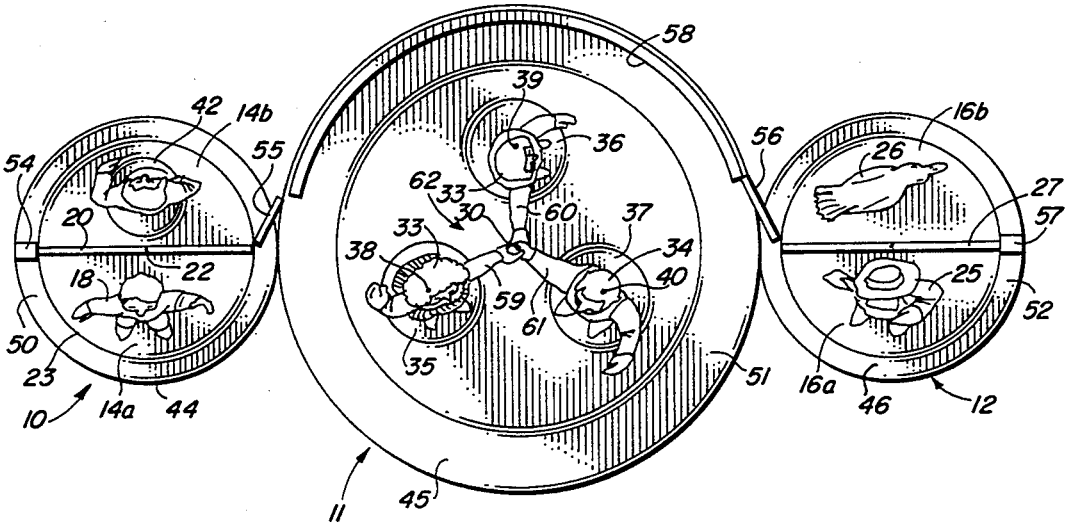
FIG. 2 is a top plan view of the show of FIG. 1.

As shown in FIGS. 1 and 2, the show is presented on a plurality of left, center and right stages 10, 11, 12, each providing a respective base platform 14, 15, 16 for exhibiting a different one or more of the characters. Characters 18, 19 are exhibited on different halves **14*a*, 14*b* of turntable 14 defined by a vertical partition 20 extending diametrically between them. Each side of the partition depicts a different scene 21 which can be presented to the exclusion of the other by appropriate angular orientation of turntable 14 about a central rotary axis 22. Character 18 is located about midway between the center 22 and a circular edge 23 of the top surface of turntable half 14*a*. Character 19 is similarly positioned relative to turntable half 14*b* on the other side of partition 20. Characters 25, 26 are exhibited in similar manner on opposite halves 16*a*, 16*b* (FIG. 2) of turntable 16, divided by a vertical partition 27. Turntable 16 can likewise be rotated about a vertical rotary axis 28** passing through its center.

The base turntable 15 of center stage 11 is also made rotatable about its central vertical axis 30. In accordance with the principles of the invention, however, each character 32, 33, 34 is supported on its own respective pedestal turntable 35, 36, 37 for independent rotation about a separate respective pedestal central vertical axis 38, 39, 40, generally coincident with the center of the supported character 32, 33, 34. The pedestals 35, 36, 37 are arranged so that axes 38, 39, 40 will be located at equiangular-spaced intervals about the axis 30. Each character 18, 19, 25, 26, 32, 33 and 34 comprises a life-size, electronically-controlled figure having a skeletal framework with articulated jointed body part simulating segments whose relative movements are effected in accordance with computer preprogramming. Individual body part segment articulation to simulate real-life movements is implemented in accordance with well-known principles. Electrical communication therefor can be either implemented through concealed umbilical connection or through some other known electromagnetic wireless transmission means.

Character 19 is shown mounted on a rotary pedestal 42 supported on base turntable 14, similar to the support of characters 32, 33, 34 on pedestals 35, 36, 37, in order to illustrate the optional extension of independent rotating pedestal mountings also to any or all of the characters supported by the base turntables 14, 16 on the side stages 10, 12. The substructure beneath the top surfaces of stages 10, 11, 12 is hidden from the audience by fixed cylindrical shells 44, 45, 46, having vertical front facades 47, 48, 49 and horizontal annular regions, 50, 51, 52 circumferentially bordering turntables 14, 15, 16.

Vertical panels 54, 55, 56, 57 positioned over the regions 50, 51, 52, span gaps between the rotating partitions 20, 27 and an arcuate vertical backdrop rising up circumferentially at the back of stage 11.

In accordance with a feature of the invention, each character 32, 33, 34 is provided with arm body part segments 59, 60, 61, movable to generally horizontal, hand-extended positions, as shown. Pedestals 35, 36, 37 are positioned with their axes 38, 39, 40 radially spaced from axis 30 of base turntable 15 so that the hand ends of arms 59, 60, 61 can be brought into apparent juxtaposed positions in a central zone of interaction 62 proximate the axis 30. In this way, when pedestals 35, 36, 37 are rotated to bring the extended hands into apparent juxtaposed positions and turntable 15 is rotated, characters 32, 33, 34 will appear to join hands and dance around the center of stage 11. The extended arms 59, 60, 61 can then be retracted, and the opposite arms extended into the same apparent hand-joined positions, with the pedestals 35, 36, 37 rotated by 180° to face characters 32, 33, 34 in the opposite direction. Turning turntable 15 in the opposite direction about axis 30 will then give the illusion that the characters are now holding hands and dancing in the opposite direction about the same center of the stage. If desired, a prop, such as a pole 63 (shown in dot-dashed lines in FIG. 3), can be erected to extend upward at the center of the stage coincident with the axis 30. In such case, characters 32, 33, 34 will appear to dance first one way, then the other, around the pole, giving a very pleasing effect.

Figure 3:
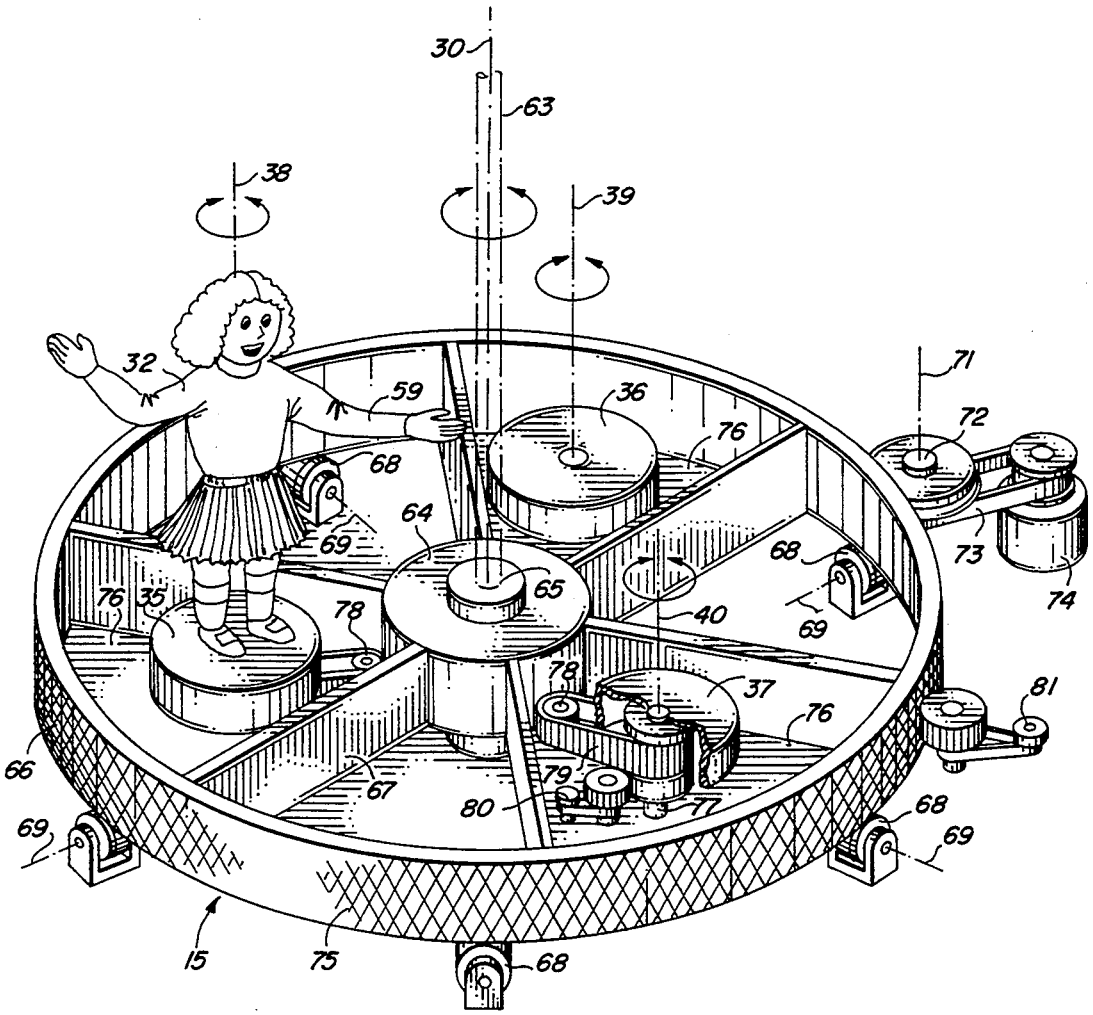
FIG. 3 is a schematic view showing the operable elements of the nested turntable arrangement of FIGS. 1 and 2.

FIG. 3 is a schematic representation of one way to implement the stage 11, shown with the top surface of turntable 15 removed and pedestal 37 cut away. As illustrated, turntable 15 includes an annular hub 64 mounted for rotation about a central vertical axle 65 coincident with rotary axis 30. A circular ring 66 that defines the circumferential perimeter of turntable 15 is supported on hub 64 by a plurality of equiangular-spaced radial spokes 67. The bottom edge of ring 66 is supported by correspondingly equiangular-spaced members, such as rubber wheels 68, mounted on the floor and journalled for free rotation about radially directed rotary axes 69. Ring 66 also includes a vertically directed cylindrical surface 75, which is covered with diamond plate aluminum or otherwise roughened, for frictional engagement with the outside diameter of a rubber drive wheel 70. Wheel 70 is mounted for rotation about a vertical axis 71 on a shaft 72, which is driven by a continuous chain belt 73 by the output shaft of a motor 74. Motor 74 is under control of preprogrammed signals from a computer for driving turntable 15 about axis 30 in synchronization with the animated articulations of characters 32, 33, 34.

A plurality of horizontal platforms 76 formed intermediate pairs of the spokes 67 serve to respectively support pedestals 35, 36, 37 for rotation with stage 15. Pedestals 35, 36, 37 are also separately, individually rotatable on shafts 77 fixed on platforms 76 and respectively coincident with the axes 38, 39, 40. Each shaft 77 is driven by an associated motor 78 through a chain belt connection 79, to independently control the rotation of the associated pedestal 35, 36, 37 about its axis 38, 39, 40. Electrical power for control of the motors 78 can be furnished by umbilical connections, whose lengths are chosen to permit 240° or 360° or other desired rotation of base turntable 15 relative to the floor. Servo-type potentiometer assemblies 80, 81 or similar mechanisms are provided for identifying angular orientations of the pedestal turntables relative to the base turntable, and the base turntable relative to the floor, to serve as feedback input signals to the animation control system.

In operation, characters 32, 33, 34 can be independently rotated about their respective pedestal axes 38, 39, 40 by separate control of their associated motors 78, either apart from or in conjunction with rotation of the base turntable 15 under action of motor 74. The characters 32, 33, 34 can be turned toward or away from each other, or toward or away from the side characters 18, 19, or 25, 26; and can be caused to simultaneously rotate in one or the other direction about the common axis 30. On the one hand, each character 32, 33, 34 is accommodated to rotate about a separate axis central to that character alone; and, on the other hand, the same characters are accommodated to collectively rotate about a common axis removed from each, but central to all. For the shown three character nested turntable arrangement shown, characters 32, 33, 34 are positioned at 120° equiangular intervals about axis 30 of base turntable 15.

Those skilled in the art to which the invention relates will appreciate that other substitutions and modifications can be made to the described embodiment without departing from the spirit and scope of the invention as described by the claims below.

What is claimed is:

1. A stage for use in an animation show multimedia performance presentation utilizing sound synchronized robotics, said stage comprising:

a base turntable;

means for rotating said base turntable about a first rotary axis;

a plurality of pedestal turntables mounted on said base turntable for rotation with said base turntable about said first rotary axis;

means for independently of rotation of said base turntable, separately rotating said pedestal turntables relative to said base turntable about separate respective second rotary axes; and a plurality of animated characters respectively supported on different ones of said pedestal turntables, and including arm body part segments, said arm segments having hand ends and being movable to generally horizontal hand-extended positions;

said first axis, pedestal turntables, second axes and characters being relatively dimensioned, configured and positioned so that said pedestal turntables can be rotated about said second axes by said independently rotating means, with said arm segments in said hand-extended positions, to bring said hand ends of said characters on said different ones of said pedestal turntables into juxtaposed positions proximate said first axis.

2. The stage of claim 1, wherein said means for rotating said base turntable comprises a first motor and means supporting said base turntable for rotation by said first motor; and said means for rotating said pedestal turntables comprises a plurality of second motors mounted on said base turntable and means for respectively rotating said pedestal turntables by said second motors.

3. The stage of claim 2, further comprising feedback means mounted on said base turntable and associated with each of said second motors for identifying angular orientations of each of said pedestal turntables relative to said base turntable; and feedback means associated with said first motor for identifying angular orientation of said base turntable relative to a floor.

4. The stage of claim 2, wherein said means supporting said base turntable comprises an axle coincident with said first rotary axis; said base turntable is mounted for rotation on said axle and includes a circumferential perimetrical surface; and said first motor comprises a computer-controlled motor having a drive wheel in frictional engagement with said perimetrical surface.

5. The stage of claim 4, wherein a plurality of shafts are mounted on said base turntable; said pedestals are respectively mounted on said shafts; said second motors comprise computer-controlled motors connected by continuous belts to drive said shafts.

6. The stage of claim 5, further comprising feedback means mounted on said base turntable and associated with each of said second motors for identifying angular orientations of each of said pedestal turntables relative to said base turntable; and feedback means associated with said first motor for identifying angular orientation of said base turntable relative to a floor.

7. In a method of presenting an animation show featuring a plurality of animated characters including arm body part segments, said arm segments having hand ends and being electronically-controllably movable to generally horizontal hand-extended positions, and employing computer-controlled, sound synchronized robotics to cause interaction among said animated characters in a multimedia performance presentation, the improvement comprising:

supporting each of said characters on its own respective different pedestal turntable for independent, electronically-controlled separate rotation of said character about a separate respective pedestal rotary axis generally coincident with the center of said supported character;

supporting said pedestal turntables on a common base turntable for common rotation of said pedestal turntables, independently controllable of said rotations about said pedestal rotary axes, simultaneously about a common base rotary axis;

moving said arm segments to said hand-extended positions;

rotating said pedestal turntables about said rotary axes to bring said hand ends of said arm body part segments of said characters supported on said different pedestal turntables into juxtaposed positions proximate said base rotary axis; and rotating said base turntable about said base rotary axis with said hand ends in said juxtaposed positions.

8. The improvement of claim 7, wherein said characters include left and right arm body part segments, with said left and right arm segments having corresponding left and right hand ends and being movable to corresponding generally horizontal right and left hand-extended positions, and wherein said moving and rotating steps comprise:

moving said arm segments to said right hand-extended positions;

rotating said pedestal turntables to bring said right hand ends into right hand end juxtaposed positions;

rotating said base turntable in a direction about said base rotary axis with said right hand ends in said right hand end juxtaposed positions;

moving said arm segments to said left hand-extended positions;

rotating said pedestal turntables to bring said left hand ends into left hand juxtaposed positions; and rotating said base turntable in an opposite direction about said base rotary axis with said left hand ends in said left hand end juxtaposed positions.

9. The improvement of claims 7, further including the step of providing a pole extending up from said base turntable coincident with said base rotary axis, and wherein in said pedestal turntable rotating step said hand ends are brought into juxtaposed positions proximate said pole.

10. In a stage setup for use in an animated show multimedia performance presentation utilizing sound synchronized robotics, said setup including a stage, animated characters supported on said stage, each character having arm body part segments with hand ends, and means for electronically-controllably articulating said arm segments, the improvement comprising:

said stage comprising a base turntable; means for rotating said base turntable about a first axis; a plurality of pedestal turntables mounted on said base turntable; and means for, independently of said rotating of said base turntable, separately rotating said pedestal turntables about respective second axes; and said characters being respectively mounted on different ones of said pedestal turntables.

11. The improvement of claim 10, wherein said first axis, pedestal turntables, second axes and characters are relatively dimensioned, configured and positioned so that said pedestal turntables can be rotated about said second axes, and said arm segments articulated to bring said hand ends of said characters mounted on said different pedestal turntables into juxtaposed positions proximate said first axis.

12. The improvement of claim 11, wherein said base turntable has a center, said first axis passes through said base turntable center, said pedestal turntables have centers, said second axes respectively pass through said pedestal turntable centers, said characters have centers, and said characters are mounted on said pedestal turntables with said character centers respectively generally coincident with said second axes.

13. The improvement of claim 12, wherein said stage is a center stage; said setup further comprises left and right stages positioned respectively left and right of said center stage; each of said left and right stages comprises another base turntable, and means for rotating said another base turntable about a third axis; and said setup further comprises other characters respectively mounted on said separate base turntables.

14. The improvement of claim 13, wherein at least one of said left and right stages further includes another pedestal turntable mounted on said corresponding another base turntable, and means for rotating said another pedestal turntable about a fourth axis; and at least one of said other characters is supported on said another pedestal turntable.

* * * * *